US008340540B2

(12) United States Patent
Gross et al.

(10) Patent No.: US 8,340,540 B2
(45) Date of Patent: Dec. 25, 2012

(54) DUAL REGISTRATION AND PROCESS CONTROL TONED PATCHES

(75) Inventors: Eric M Gross, Rochester, NY (US); Edward W Smith, Jr., Rochester, NY (US)

(73) Assignee: Xerox Corporation, Norwalk, CT (US)

( * ) Notice: Subject to any disclaimer, the term of this patent is extended or adjusted under 35 U.S.C. 154(b) by 232 days.

(21) Appl. No.: 12/862,999

(22) Filed: Aug. 25, 2010

(65) Prior Publication Data

US 2012/0051767 A1 Mar. 1, 2012

(51) Int. Cl.
*G03G 15/00* (2006.01)

(52) U.S. Cl. ..... 399/49; 399/72

(58) Field of Classification Search ..... 399/49, 399/72

See application file for complete search history.

(56) References Cited

U.S. PATENT DOCUMENTS 6,847,791 B2 * 1/2005 Kitagawa et al. ..... 399/49
7,777,896 B2 * 8/2010 Ueda et al. ..... 356/601

* cited by examiner

*Primary Examiner* — Hoang Ngo

(57) ABSTRACT

A method and apparatus saves on toner cost and improves productivity for running registration and color process controls in a printer by making dual use of patches for both functions. That is, the small patches normally used only for registration measurement are also used for xerographic process control measurements, thereby eliminating the need for large patches and obtaining registration information and color control information at the same time. The dual use of small patches to measures both registration and color process control is made possible by periodically establishing correlation between the density of large density patches and the smaller registration patches.

20 Claims, 2 Drawing Sheets

DUAL REGISTRATION AND PROCESS CONTROL TONED PATCHES

BACKGROUND

1. Field of the Disclosure

This invention relates in general to an image forming apparatus, and more particularly, to an image forming apparatus employing a method and apparatus for saving on toner cost and maximizing productivity.

2. Description of Related Art

In office products (tandem architectures) the color control requires the rendering of process control patches which result in a tradeoff between the benefits of improved color regulation against the costs incurred by toner usage, lost productivity, and component wear. In addition, color registration adjustments also come with the costs of lost productivity and toner usage.

Typically, in office products, the xerographic controls uses a set of toned patches that are, relative to registration patches, large in size. This is so since process controls is concerned with measuring the average density of a patch where registration is concerned with measuring the location of the patch edge only. Furthermore, in many products the same optical sensor is used to sense both controls and registration patches. The signal processing is done by different systems, typically in hardware for the high speed requirement of registration and in software for the purpose of color control. Sampling rates may be different, though not necessarily different. Finally, the number of patches required for registration is usually larger than that required for process controls.

The toner usage is a function of the number of sampling events, number of patches and the average developed mass per unit area. Decreasing anyone of these factors will result in a toner savings.

The total toner usage per unit time is directly related to toner consumption cost. Also, there is cost due to lost productivity since dead cycling is often required to render and measure registration and process controls patches.

Thus, there is a long felt need to reduce lost productivity and toner consumption during the color registration and color control functions.

BRIEF SUMMARY

Accordingly, because of dead cycling overhead (most office products require component caming, for example), productivity enhancements can be captured if registration and process controls are sampled during the same dead cycle. Though they may require different sampling intervals, at least it may be possible to occasionally run both sets of patches during the same dead cycle. The overall systems optimization of lost productivity and toner usage can be enabled by having the process control patches be the same small geometric shape as the registration patches.

The disclosed reprographic system incorporates the disclosed improved method for reducing toner costs and improving productivity for running registration and other process control features. It is well-known and preferable to program and execute imaging, printing, paper handling, and other control functions and logic with software instructions for conventional or general purpose microprocessors, as taught by numerous prior patents and commercial products. Such programming or software may, of course, vary depending on the particular functions, software type, and microprocessor or other computer system utilized, but will be available to, or readily programmable without undue experimentation from, functional descriptions, such as, those provided herein, and/or prior knowledge of functions which are conventional, together with general knowledge in the software of computer arts. Alternatively, any disclosed control system or method may be implemented partially or fully in hardware, using standard logic circuits or single chip VLSI designs.

The term 'sheet' herein refers to any flimsy physical sheet or paper, plastic, or other useable physical substrate for printing images thereon, whether precut or initially web fed. A compiled collated set of printed output sheets may be alternatively referred to as a document, booklet, or the like. It is also known to use interposes or inserters to add covers or other inserts to the compiled sets.

As to specific components of the subject apparatus or methods, or alternatives therefore, it will be appreciated that, as normally the case, some such components are known per se' in other apparatus or applications, which may be additionally or alternatively used herein, including those from art cited herein. For example, it will be appreciated by respective engineers and others that many of the particular components mountings, component actuations, or component drive systems illustrated herein are merely exemplary, and that the same novel motions and functions can be provided by many other known or readily available alternatives. All cited references, and their references, are incorporated by reference herein where appropriate for teachings of additional or alternative details, features, and/or technical background. What is well known to those skilled in the art need not be described herein.

BRIEF DESCRIPTION OF THE DRAWINGS

Various of the above-mentioned and further features and advantages will be apparent to those skilled in the art from the specific apparatus and its operation or methods described in the example(s) below, and the claims. Thus, they will be better understood from this description of these specific embodiment(s), including the drawing figures (which are approximately to scale) wherein:

DETAILED DESCRIPTION OF THE PREFERRED EMBODIMENT

Figure 1:
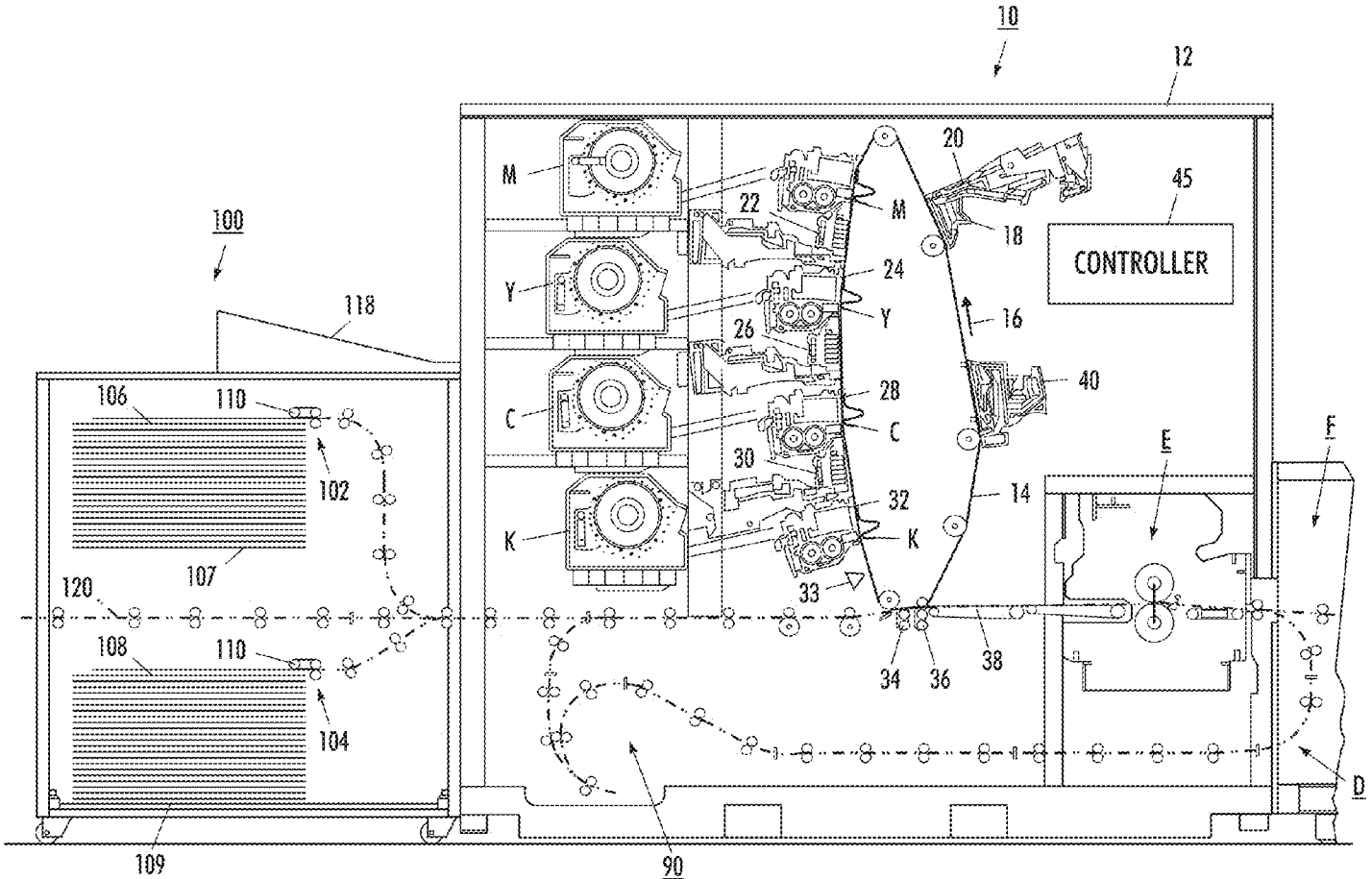
FIG. 1 is a partial, frontal view of an exemplary modular xerographic printer that includes the xerographic process controls scheduling approach of the present disclosure.

While the disclosure will be described hereinafter in connection with a preferred embodiment thereof, it will be understood that limiting the disclosure to that embodiment is not intended. On the contrary, it is intended to cover all alternatives, modifications and equivalents as may be included within the spirit and scope of the disclosure as defined by the appended claims.

The disclosure will now be described by reference to a preferred embodiment xerographic printing apparatus that includes a method and apparatus for reducing the amount and thereby the cost of toner consumed by the printer apparatus.

For a general understanding of the features of the disclosure, reference is made to the drawings. In the drawings, like reference numerals have been used throughout to identify identical elements.

Referring now to printer 10 in FIG. 1, as in other xerographic machines, and as is well known, an electrographic printing system is shown including the improved method and apparatus where color consistency and color registration is maintained in the printer by making multiple uses of patches for both color registration and color processing. The term "printing system" as used here encompasses a printer apparatus, including any associated peripheral or modular devices, where the term "printer" as used herein encompasses any apparatus, such as a digital copier, bookmaking machine, facsimile machine, multifunction machine, etc., which performs a print outputting function for any purpose. Marking module 12 includes a charge retentive substrate which could be a photoreceptor belt 14 that advances in the direction of arrow 16 through the various processing stations around the path of belt 14. Charger 18 charges an area of belt 14 to a relatively high, substantially uniform potential. Next, the charged area of belt 14 passes laser 20 to expose selected areas of belt 14 to a pattern of light, to discharge selected areas to produce an electrostatic latent image. Next, the illuminated area of the belt passes developer unit M, which deposits magenta toner on charged areas of the belt.

Subsequently, charger 22 charges the area of belt 14 to a relatively high, substantially uniform potential. Next, the charged area of belt 14 passes laser 24 to expose selected areas of belt 14 to a pattern of light, to discharge selected areas to produce an electrostatic latent image. Next, the illuminated area of the belt passes developer unit Y, which deposits yellow toner on charged areas of the belt.

Subsequently, charger 26 charges the area of belt 14 to a relatively high, substantially uniform potential. Next, the charged area of belt 14 passes laser 28 to expose selected areas of belt 14 to a pattern of light, to discharge selected areas to produce an electrostatic latent image. Next, the illuminated area of the belt passes developer unit C, which deposits cyan toner on charged areas of the belt.

Subsequently, charger 30 charges the area of belt 14 to a relatively high, substantially uniform potential. Next, the charged area of belt 14 passes laser 32 to expose selected areas of belt 14 to a pattern of light, to discharge selected areas to produce an electrostatic latent image. Next, the illuminated area of the belt passes developer unit K, which deposits black toner on charged areas of the belt.

As a result of the processing described above, a full color toner image is now moving on belt 14. In synchronism with the movement of the image on belt 14, a conventional registration system receives copy sheets from sheet feeder module 100 and brings the copy sheets into contact with the image on belt 14. Sheet feeder module 100 includes high capacity feeders 102 and 104 that feed sheets from sheet stacks 106 and 108 positioned on media supply trays 107 and 109 and directs them along sheet path 120 to imaging or marking module 112. Additional high capacity media trays could be added to feed sheets along sheet path 120, if desired.

A corotron 34 charges a sheet to tack the sheet to belt 14 and to move the toner from belt 14 to the sheet. Subsequently, detack corotron 36 charges the sheet to an opposite polarity to detack the sheet from belt 14. Prefuser transport 38 moves the sheet to fuser E, which permanently affixes the toner to the sheet with heat and pressure. The sheet then advances to stacker module F, or to duplex loop D.

Cleaner 40 removes toner that may remain on the image area of belt 14. In order to complete duplex copying, duplex loop D feeds sheets back for transfer of a toner powder image to the opposed sides of the sheets. Duplex inverter 90, in duplex loop D, inverts the sheet such that what was the top face of the sheet, on the previous pass through transfer, will be the bottom face on the sheet, on the next pass through transfer. Duplex inverter 90 inverts each sheet such that what was the leading edge of the sheet, on the previous pass through transfer, will be the trailing on the sheet, on the next pass through transfer.

With further reference to FIG. 1 and in accordance with the present disclosure, a simple method and apparatus for maintaining color registration and color consistency in printer 10 is disclosed that includes an algorithm and a pre-transfer reflective sensor for recording diffuse and/or specular reflected light from a patch developed on drum or belt photoreceptor substrate 14. As shown, the pre-transfer sensor 33 is a conventional optical sensor and is used to send signals back to controller 45.

Figure 2:
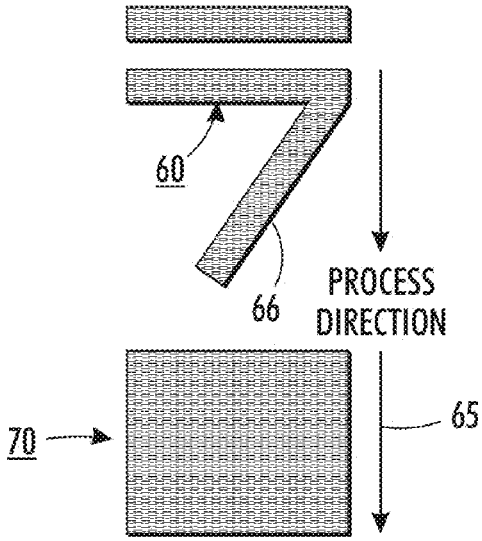
FIG. 2 PRIOR ART
FIG. 2 is plan view of two conventional patches used to measure process direction registration and process direction color control.

A long held design rule of thumb has been to make process control patches somewhat larger than the field of view of sensor 33 and allow enough time for the sensor response to stabilize (transient dies away), after which the sensor read is captured. The patch sizes are generally about 17 mm in length in the process direction. Optical sensor 33 has a field of view of about 3 mm. In FIG. 2, a separate process direction registration patch 60 and color process control patch 70 are shown positioned for sensing a process direction width of 1 mm in the direction of arrow 65. The process direction registration patch 60 includes a diagonal component 66 for inboard-outboard registration measurement. Process controls patch 70 normally has a process direction width of 17 mm.

Figure 3:
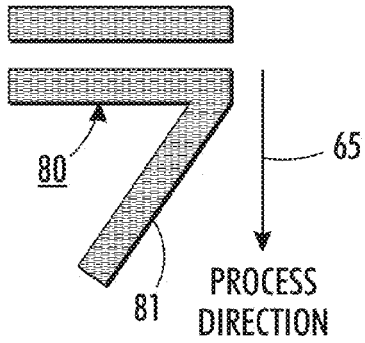
FIG. 3 is a plan view of a dual process direction registration patch and process control patch.

An improved algorithm in accordance with the present disclosure saves on the toner cost of running registration and color process controls by making multiple use of the patch 80 for both registration and color intensity functions. Dual process control patch 80, as shown in FIG. 3, includes a diagonal component 81 for inboard-outboard registration measurement. Patch 80 is used as both a process direction registration patch and a process control patch and includes a process direction width of 1 mm. The algorithm requires that the process control patches are calibrated to the registration patches and thereby overcome the process control design rule that has long dictated that process control patches must be relatively large. The process control to registration patch calibration mode should be run if the sensor is replaced, if belts are replaced, or possibly if the incident light intensity of the sensor is changed. This mode consists of passing a full size process control patch at the process control patch digital area coverage (DAC) value under the optical sensor 33 and recording the result. Next, the narrow width registration patch is passed under the sensor and the sensor response is sampled quickly (~1 ms rate) and the data collected. This process is repeated at each DAC value that is required by process control. This would mostly be a solid and medium density patch. Either the peak value or the integrated (i.e. area under the curve) value can then be used to establish process controls set point. In this way, a direct correlation is established between the sensor response to the full size process control patches and the sensor response to the reduced size (reduced to registration size) patches. With this calibration curve, the system can proceed to render only the registration size patches.

It should be noted that using the registration patch for both registration and color controls requires halftoning some of the registration patches. The registration signal at some point will degrade. Thus, a threshold should be established. Under this constraint, not all registration size control patches may be used as registration patches, but all registration patches can be used as color control patches.

In recapitulation, a method and apparatus has been disclosed that saves on toner cost and captures improved productivity for running registration and color process controls in a printer by making multiple uses of patches for both functions. Specifically, the small patches normally used only for registration measurement are also used for xerographic process control measurements, eliminating the need for large patches. This is made possible by a method of periodically establishing a correlation between the density of large density patches and the smaller registration patches.

The claims, as originally presented and as they may be amended, encompass variations, alternatives, modifications, improvements, equivalents, and substantial equivalents of the embodiments and teachings disclosed herein, including those that are presently unforeseen or unappreciated, and that, for example, may arise from applicants/patentees and others. Unless specifically recited in a claim, steps or components of claims should not be implied or imported from the specification or any other claims as to any particular order, number, position, size, shape, angle, color, or material.

What is claimed is:

1. A method for saving on toner costs by controlling color registration and color density in a reprographic device, comprising:

(a) providing a charge retentive surface;

(b) providing toner for developing an image on said charge retentive surface;

(c) providing a single patch adapted to be used for both registration and color density functions on said charge retentive surface, said single patch including a diagonal component;

(d) applying toner to said single patch;

(e) providing a sensor to sense said toner on said single patch;

(f) providing a controller for receiving signals from said sensor; and (g) using signals from said sensor by said controller to control both color registration and color density.

2. The method of claim 1, wherein said single patch includes a portion thereof used as a process direction color registration patch.

3. The method of claim 2, wherein said single patch includes a portion thereof used as a process direction color control patch.

4. The method of claim 1, including calibrating a color control patch to a color registration patch.

5. The method of claim 4, wherein said calibrating of said color control patch to said color registration patch includes: passing a full size color control patch under said sensor at a predetermined color control patch digital area coverage value and recording the result; passing a narrow width color registration patch under said sensor; sampling the sensor response and recording the result; repeating these measurements for each digital area coverage value that is required by process control; using an integrated value to establish a process control set point to thereby establish a direct correlation between said sensor response to said full size process control patch and said sensor response to said color registration patch; and then using this calibration curve to render only said registration patch.

6. The method of claim 5, including calibrating said color control patch to said color registration patch when said sensor is replaced.

7. The method of claim 5, including calibrating said color control patch to said color registration patch when belts are replaced.

8. The method of claim 5, including calibrating said color control patch to said color registration patch if said sensor is changed.

9. The method of claim 5, including using the peak value to establish a process control set point.

10. The method of claim 5, including sampling the response of said sensing of said color registration patch at a rate of approximately 1 ms.

11. The method of claim 4, wherein said calibrating of said color control patch to said color registration patch is initiated when said sensor is replaced.

12. The method of claim 4, wherein said calibrating of said color control patch to said color registration patch is initiated when belts in said reprographic device are replaced.

13. The method of claim 4, wherein said calibrating of said color control patch to said color registration patch is initiated if incident light intensity of said sensor is changed.

14. The method of claim 1, wherein said sensor is an enhanced toner area coverage sensor.

15. The method of claim 1, wherein said single patch is used as an inboard to outboard color registration patch.

16. The method of claim 15, including using said single patch as an inboard to outboard color control patch.

17. The method of claim 1, wherein said sensor is an optical transmissive sensor.

18. The method of claim 1, wherein said sensor is a reflective based sensor.

19. A method for saving on toner cost of running registration and color process controls in a printer, comprising:

(a) providing a charge retentive surface;

(b) providing toner for developing an image on said charge retentive surface;

(c) providing a registration patch on said charge retentive surface;

(d) applying toner to said registration patch;

(e) providing a sensor to sense said toner on said registration patch;

(f) providing a controller for receiving signals from said sensor; and (g) using signals from said sensor by said controller to control both color registration and color density.

20. A registration and color process control method in a printer, comprising:

(a) providing a charge retentive surface;

(b) providing toner for developing an image on said charge retentive surface;

(c) combining a registration patch and a color density patch into a single patch and placing the combined patch on said charge retentive surface;

(d) applying toner to said combination patch;

(e) providing a sensor to sense said toner on said combination patch;

(f) providing a controller for receiving signals from said sensor; and (g) using signals from said sensor by said controller to control both color registration and color density.

* * * * *